United States Patent [19]

Klötzer

[11] Patent Number: 4,605,610

[45] Date of Patent: Aug. 12, 1986

[54] EMULSION RICH IN SILVER CHLORIDE, PHOTOGRAPHIC RECORDING MATERIAL AND PROCESS FOR THE PRODUCTION OF PHOTOGRAPHIC RECORDINGS

[75] Inventor: Sieghart Klötzer, Cologne, Fed. Rep. of Germany

[73] Assignee: Agfa-Gevaert Aktiengesellschaft, Leverkusen-Bayerwerk, Fed. Rep. of Germany

[21] Appl. No.: 708,722

[22] Filed: Mar. 6, 1985

[30] Foreign Application Priority Data

Mar. 15, 1984 [DE] Fed. Rep. of Germany ..... 3409445

[51] Int. Cl.[4] ..... G03C 7/26; G03C 1/02

[52] U.S. Cl. ..... 430/376; 430/543; 430/567; 430/570; 430/599; 430/603

[58] Field of Search ..... 430/567, 940, 376, 543, 430/570, 599, 603

[56] References Cited

U.S. PATENT DOCUMENTS

| | | | |
|---|---|---|---|
| 4,070,190 | 1/1978 | Friedrich et al. | 430/567 |
| 4,335,199 | 6/1982 | Mickewich et al. | 430/567 |
| 4,444,871 | 4/1984 | Miyaoka et al. | 430/378 |

FOREIGN PATENT DOCUMENTS 0080905 2/1982 European Pat. Off. .

*Primary Examiner*—Mary F. Downey

*Attorney, Agent, or Firm*—Connolly and Hutz

[57] ABSTRACT

A silver halide emulsion rich in chloride is described which has grains having a layered grain structure with a core and at least one layer encasing the core.

8 Claims, No Drawings

EMULSION RICH IN SILVER CHLORIDE, PHOTOGRAPHIC RECORDING MATERIAL AND PROCESS FOR THE PRODUCTION OF PHOTOGRAPHIC RECORDINGS

This invention relates to an emulsion rich in silver chloride, to a photographic recording material and to a process for the production of photographic recordings.

Numerous types of silver halide emulsions which contain chloride, bromide, iodide or mixtures thereof as halide are known. Silver bromide and silver bromide-iodide emulsions are generally used for more highly-sensitive recording materials. The latter emulsions suffer from the disadvantage that they have characteristic sensitivity in the blue spectral region. Therefore, green- and red- sensitive layers are generally arranged behind a filter which absorbs blue light in colour recording materials. Moreover, such emulsions cannot be developed as rapidly as silver chloride emulsions.

Diverse publications disclose proposals for the use of silver chloride emulsions. As silver chloride has almost no characteristic sensitivity in the visible spectrum, it is unnecessary to use filter layers which absorb the blue light (yellow filter) when silver halide emulsions rich in chloride are used in a colour-photographic recording material. The sensitivity is improved according to EP-A No. 0 017 148 by doping with metal. Silver halide emulsions rich in chloride also have poor stability in storage and thus have a tendency to fog. Fogging is reduced during chemical maturing according to EP-A No. 0 072 695 by the use of silver halide solvents.

Chloride-containing silver halide emulsions in which the grains have a layered structure are also known. Such grains have a core and at least one layer encasing the core, which layer differs from the core by the properties thereof. Thus, it is known from DE-AS No. 1 169 290 and GB No. 1 027 146 to precipitate a shell of silver chloride onto a core of silver bromide. DE-OS No. 2 308 239 and U.S. Pat. No. 3,935,014 relate to emulsions for the production of direct-positive images having silver halide grains which have a positionally-limited phase with a high content of silver chloride.

Silver halide emulsions with grains rich in silver chloride are known from EP-A No. 0 080 905, which grains have a layer substantially consisting of silver bromide on the surface thereof.

The known silver halide emulsion rich in chloride also require improvement, particularly with regard to their sensitivity and tendency to fog.

Thus, an object of the present invention is to provide silver halide emulsions rich in chloride which have improved sensitometric properties. A particular object of the present invention is to increase the sensitivity and reduce the tendency to fog without impairing the kinetics of development.

A photographic silver halide emulsion has been found which substantially contains chloride as halide and the grains of which have a layered grain structure consisting of at least two regions having a differing halide composition—for example, a core and at least one shell.

The silver halide grains are characterised in that 1. at least 60 mol % of the halide is chloride and 2. at least one region B contains at least 10 mol % silver bromide, preferably at least 25 mol % silver bromide, but less than 50 mol %, silver bromide.

Region B can be in the form of a core or a shell around a core. Additionally to AgBr silver chloride and optionally silver iodide, preferably up to 10 mol %, is present in region B. The grains preferably contain a core encased by at least one region B. In this case, region B can be in the form of a shell within the silver halide grain or on the surface of the crystal.

In a particular embodiment of the present invention, the crystal core is successively provided with two silver bromide-containing shells the bromide content of both shells markedly differing.

A bromide-containing shell with a positional concentration of from 30 to 45 mol % bromide is preferably located on the crystal surface of the silver halide crystal rich in chloride.

In a further embodiment, the bromide concentration is from 3 to 8 mol %, based on the total quantity of halide.

The silver halide grains in the core and in the other regions can in principle contain chloride, bromide, iodide or mixtures thereof as halide. The transition from one region to an adjacent region having a different composition can be abrupt or continuous.

In a preferred embodiment, the chloride proportion of the total halide content is at least 85 mol %, preferably at least 90 mol %.

The silver halide emulsions according to the invention can be produced by conventional methods (e.g. single-jet, double-jet, with constant or accelerated supply of material). The emulsions are most preferably produced by the double-jet process with control of the pAg value. Reference is hereby made to the publication Research Disclosure No. 17643 of December 1978, Sections I and II, published by Industrial Opportunities Ltd., Homewell, Havant, Hampshire, PO9 1EF, Great Britain. The silver halide precipitation may be conducted in the presence of dopants, e.g. of Ir-compounds.

The silver halide grains can, for example, be in the form of cubes, octahedrons or tetradecahedrons. The grain size is preferably from 0.1 to 2.5 μm, more particularly from 0.2 to 1.0 μm.

In one embodiment of the present invention the emulsion has a narrow grain size distribution. Particularly in this instance, 95 % by weight of the grains have a diameter which does not deviate by more than 40% from the average grain diameter. However, the emulsions can also have a wide grain size distribution. In this case, at least 10%, preferably 20%, of the silver halide grains have a diameter which deviates by at least 40% from the average grain diameter.

The present invention also relates to a photographic recording material which has at least one silver halide emulsion layer according to the present invention on a substrate. The invention also relates to a process for the production of photographic recordings by developing an exposed recording material according to the invention.

The emulsions according to the invention are preferably chemically sensitized on the surface of the grains to produce a high surface-sensitivity. They can be chemically sensitized by known methods, such as using active gelatine or compounds of sulphur, selenium, tellurium, gold, palladium, platinum, iridium, the pAg values fluctuating between 4 and 10, the pH values fluctuating between 3.5 and 9 and the temperature fluctuating between 30° and 90° C.; chemical-sensitization can be carried out in the presence of heterocyclic nitrogen compounds, such as imidazoles, azaindenes, azapyridazines and azapyrimidines and thiocyanate derivatives, thioethers and other silver halide solvents. As an alternative or in addition thereto, the emulsions according to the invention can undergo reduction sensitization, by, for example, hydrogen, by low pAg (e.g. less than 5) and/or high pH (e.g. more than 8), by reducing agents, such as tin (II) chloride, thiourea dioxide and aminoboranes. The ripening nucleii on the surface can also be in the form of troglodyte nucleii (sub-surface nucleii) according to DE-OS No. 2 306 447 and U.S. Pat. No. 3,966,476. The grains may also be ripened internally. Other methods are described in the above-mentioned Research Disclosure No. 17643 in Section III.

The emulsions can be optically-sensitized in known manner, using for example conventional polymethine dyes, such as neutrocyanines, basic or acidic carbocyanines, rhodacyanines, hemicyanines, styryl dyes, oxonoles and the like. Such sensitizers are described by F. M. Hamer in "The Cyanine Dyes and related Compounds" (1964). Reference is hereby made to EP-A No. 0 082 649, more particularly to Ullmanns Encyclopadie der technischen Chemie, 4th Edition, Vol 18, pages 431 et seq and to the above Research Disclosure No. 17643, Section IV. The spectral sensitization can be carried out at any point during the production of the emulsion, that is to say during or subsequent to precipitation of the silver halide and before, during or subsequent to chemical sensitization.

The conventionally-used anti-fogging agents and stabilizers can be used.

Azaindenes, preferably tetra- or penta-azaindenes, more particularly those which are substituted by hydroxyl or amino groups, are particularly suitable as stabilizers. Compounds of this type are described, for example, in the article by Birr, Z. Wiss. Phot. 47(1952), P. 2–58. Further suitable stabilizers and anti-fogging agents are given in section IV of the above Research Disclosure No. 17643.

The recording material according to the invention is preferably a colour-photographic recording material. In a preferred embodiment, the colour image is produced with the aid of colour couplers. It is possible to allow the colour coupler to diffuse into the recording material as late as during the development thereof.

In a preferred embodiment, the photographic material itself contains the conventional colour couplers which can react with the oxidation product of developers, generally p-phenylene diamines, with the formation of dyes. Thus, the red-sensitive layer, for example, can contain a non-diffusing colour coupler, generally a coupler of the phenol or $\alpha$-naphthol type, to produce the cyan partial colour image. The green-sensitive layer can, for example, contain at least one non-diffusing colour coupler to produce the magenta partial colour image, colour couplers of the 5-pyrazolone type conventionally being used. The blue-sensitive layer can, for example, contain a non-diffusing colour coupler to produce the yellow partial colour image, generally a colour coupler with an open-chain ketomethylene group. The colour couplers can, for example, be 6-, 4- and 2-equivalent couplers, including the so-called white coupler which does not produce any dye on reaction with colour-developing oxidation products. Suitable couplers are known, for example, from the publications "Farbkuppler" by W. Pelz in "Mitteilungen aus den Forschungslaboratorien der Agfa, Leverkusen/Munich", Vol III, page 111 (1961), K. Venkataraman in "The Chemistry of Synthetic Dyes", Vol. 4, 341 to 387, Academic Press (1971) and T.H. James, "The Theory of the Photographic Process", 4th Ed. pages 353–362, and from the Research Disclosure No. 17643, Section VII.

The recording material can also contain DIR-compounds. DIR-compounds are to be understood as designating those compounds which release diffusing organic compounds during the reaction with colour-developing oxidation products, which compounds inhibit the development of silver halide. The inhibitors can be separated off directly or via non-inhibiting intermediate compounds. Reference is hereby made to GB No. 953 454, U.S. Pat. Nos. 3,632,345, 4,248,962 and GB No. 2 072 363.

The colour couplers and DIR compounds can be incorporated into the materials according to the invention by conventional methods. If these are water- or alkali-soluble compounds they can be added in the form of aqueous solutions, optionally with addition of water-miscible organic solvents, such as ethanol, acetone or dimethyl formamide. If the colour couplers and DIR-compounds compounds are water- or alkali-insoluble, they can be incorporated in known manner in dispersed form into the recording material. A solution of these compounds in a low-boiling organic solvent can, for example, be mixed directly with a silver halide emulsion or mixed firstly with an aqueous gelatine solution and the organic solvent can subsequently be removed. The dispersion of the compound used which is obtained in this manner can then be mixed with the silver halide emulsion. So-called oil-formers are optionally also used, which are generally relatively high-boiling organic compounds which encapsulate the colour couplers and DIR-compounds in the form of oily drops. Reference is made in this context to U.S. Pat. Nos. 2,322,027, 2,533,514, 3,689,271, 3,764,336 and 3,765,897, for example.

The recording materials according to the invention preferably contain at least one silver halide emulsion layer unit for recording blue, green and red light.

The red-sensitive silver halide emulsion layer-unit can be arranged closer to the substrate than the green-sensitive silver halide emulsion layer-unit which, in turn, is arranged closer thereto than the blue-sensitive unit. Particularly in the case of copying materials, the position of the blue- and red-sensitive layer is interchangeable. The recording material can optionally contain a yellow filter layer; this is unnecessary if at least the red- and green-sensitive layers contain an emulsion according to the present invention.

In a preferred embodiment, at least one of the units for recording green, red and blue light consists of at least two partial layers. It is possible to combine partial layers of differing spectral sensitization according to the sensitivity thereof.

Conventional substrates can be used for the materials, according to the invention, for example substrates of celluose esters, such as cellulose acetate and polyesters. Paper substrates are also suitable, which can optionally be coated with, for example, polyolefins, more particularly with polyethylene or polypropylene. Reference is hereby made to the above-mentioned Research Disclosure No. 17643 section XVII.

Examples of conventional hydrophilic film-forming agents which are suitable as protective colloids or as binders for the layers of the recording material include proteins, more particularly gelatine, alginic acid or the derivatives thereof, such as esters, amides or salts, cellulose derivatives, such as carboxymethyl cellulose and cellulose sulphates, starch or the derivatives thereof or hydrophilic synthetic binders, such as polyvinyl alcohol, partially-saponified polyvinyl acetate, polyvinyl pyrrolidone and others. The layers can also contain other synthetic binders in dissolved or dispersed form in admixture with the hydrophilic binders, for example homo or copolymers of acrylic or methacrylic acid or the derivatives thereof, such as esters, amides or nitriles, also vinyl polymers, such as vinyl esters or vinyl ethers. Reference is hereby made to the binders given in section IX of the above-mentioned Research Disclosure 17643.

The layers of the photographic material can be hardened in a conventional manner, using, for example, hardeners of the epoxide type, the heterocyclic ethylene imine type or the acryloyl type. It is also possible to harden the layers according to the process of German Offenlegungsschrift No. 2 218 009, in order to obtain colour-photographic materials which are suitable for high-temperature processing. It is also possible to harden the photographic layers or the colour-photographic multilayered materials using hardeners of the diazine, triazine or 1,2-dihydroquinoline series or using hardeners of the vinyl sulphone type. Further suitable hardening agents are known from German Offenlegungsschriften Nos. 2 439 551, 2 225 230, 2 317 672 and from section XI, of the above Research Disclosure 17643.

The present photographic materials can also contain further substances, particularly plasticisers, wetting agents, screen dyes, light-diffusing agents, light-reflecting agents, lubricants, anti-static agents, matting agents etc. Reference is hereby made to the Research Disclosure 17643 and to the "Product Licensing Index" of December 1971, pages 107–110.

Particularly suitable colour-developing agents for the material according to the invention are of the p-phenylene diamine type, for example 4-amino-N, N-diethylaniline hydrochloride; 4-amino-3-methyl-N-ethyl-N-β-(methane sulphonamido)-ethylaniline sulphate hydrate; 4-amino-3-methyl-N-ethyl-N-β-hydroxyethyl-aniline sulphate; 4-amino-N-ethyl-N-(2-methoxy-ethyl)-m-toluidine-di-p-toluene sulphonic acid and N-ethyl-N-β-hydroxyethyl-p-phenylene diamine. Other usable colour developers are, for example, described in J. Amer. Chem. Soc 73, 3100 (1951) and in G. Haist, Modern Photographic Processing, 1979, John Wiley and Sons, New York, pages 545 et seq. The colour developers can contain the other conventional constituents, such as chalking- and oxidation-protecting agents and agents for preventing fogging, such as bromide or known stabilizers.

After colour developing, the material is conventionally bleached and fixed. Bleaching and fixing can be carried out separately or together. The conventional compounds can be used as bleaching agents, such as $Fe^{3+}$ salts and $Fe^{3+}$ complex salts, such as ferricyanides, dichromates, water-soluble cobalt complexes etc. Iron-III-complexes of amino-polycarboxylic acids, more particularly ethylene diamine tetraacetic acid, nitrilo-triacetic acid, iminodiacetic acid, N-hydroxyethyl ethylene diamine triacetic acid, alkyl imino dicarboxylic acids, and of corresponding phosphonic acids are particularly preferred. Persulphates are also suitable as bleaching agents.

EMULSION A ACCORDING TO THE INVENTION

A silver chloride emulsion is produced over a period of 25 min by the pAg-controlled double-jet inflow of a 0.3 N NaCl solution and a 0.3N $AgNO_3$ solution to a 2.5% gelatine solution which has been heated to a temperature of 55° C. The average particle size is 0.15 μm and the emulsion has a mono-disperse distribution. The crystals of this starting solution are enlarged to 36 times their original volume by further addition of 2N NaCl solution and 2N $AgNO_3$ solution. The pAg value is held constant at 6.8 during this stage.

An AgBr/AgCl shell is precipitated onto the AgCl grains produced in this manner by the simultaneous feeding-in of KBr/NaCl solution and $AgNO_3$ solution, the KBr/NaCl solution containing 40 mol % bromide.

The crystals of the emulsion produced in this manner have a mono-disperse grain size distribution and an average particle diameter of 0.53 μm; the proportion by volume of the Br/Cl shell is 10% based on the total volume of the silver halide crystals. The AgBr content is 4 mol %, based on the total quantity of halide.

COMPARATIVE EMULSION B

For the purposes of comparison, a silver halide emulsion is produced like emulsion A by pAg-controlled double-jet inflow. In this case the KBr/NaCl solution is substituted by a pure KBr solution with an identical concentration. An AgBr shell is applied to the silver chloride crystals by controlled double-feed such that the bromide concentration is 5 mol %, based on the total quantity of halide. The average particle diameter of the emulsion produced in this manner is 0.55 μm and the crystals have a mono-disperse grain size distribution.

Emulsions A and B are freed from the soluble salts in conventional manner by flocculation and washing and are then adjusted to a pAg value of 7.6. All emulsions are then chemically-sensitized by addition of sodium thiosulphate for 120 min at 55° C. For the purposes of sensitometric examination, the ripened emulsions are mixed with a sensitizing dye which is absorbent in the green spectral region and with a conventional magenta-coupler and are applied to a substrate, the application of silver being maintained constant for all layers.

After exposure behind a step wedge and processing by the colour developing process known from the British Journal of Photography, [1974] page 597, the sensitometric characteristics given in Table 1 are obtained.

TABLE 1

| Emulsion | Mol % Br total | Rel. Sens. | Fogging | D max | γ |
|---|---|---|---|---|---|
| A (invention) | 4 | 327 | 0.16 | 3.53 | 2.58 |
| B | 5 | 100 | 0.15 | 3.47 | 2.38 |

The markedly high sensitivity and steeper gradation with otherwise identical sensitometry can be seen from Table 1.

Both emulsions are mixed with a sensitizing dye which is absorbent in the blue spectral region and with a conventional yellow coupler for further examination after ripening and are applied to a substrate at a silver application corresponding to 3.2 g $AgNO_3$ per $m^2$.

After exposure behind a step wedge and processing, as given above, the sensitometric characteristics given in the following Table 2 are obtained.

TABLE 2

| Emulsion | Rel. Sens. | Fogging | D max | γ |
|---|---|---|---|---|
| A (invention) | 150 | 0.12 | 4.30 | 2.73 |

TABLE 2-continued

| Emulsion | Rel. Sens. | Fogging | D max | γ |
|---|---|---|---|---|
| B | 100 | 0.35 | 3.88 | 2.49 |

It can be seen from Table 2 that the present emulsion is superior to the comparative emulsion in all the sensitometric characteristics.

I claim:

1. A photographic silver halide emulsion which substantially contains chloride as halide and the grains of which have a layered grain structure, wherein at least 60 mol-% of the silver halide of the emulsion is silver chloride, at least one region B contains at least 25 mol-% AgBr, but less than 50 mol-% AgBr, the grains have a core encased by at least one region B.

2. A photographic silver halide emulsion according to claim 1, wherein at least 85 mol % of the total quantity of halide is in the form of silver chloride.

3. A photographic silver halide emulsion according to claim 1, wherein the average grain size is from 0.1 to 2.5 μm.

4. A photographic silver halide emulsion according to claim 1, wherein it has a narrow grain size distribution.

5. A photographic silver halide emulsion according to claim 1, wherein the emulsion has a wide grain size distribution.

6. A photographic silver halide emulsion according to claim 1, wherein the grains on the surface are chemically and/or spectrally sensitized.

7. A color photographic recording material having a substrate, at least one silver halide emulsion layer and at least one color coupler containing layer applied thereto, wherein the grains of said emulsion have a layered grain structure, wherein at least 60 mol-% of silver halide of said emulsion is silver chloride, and wherein at least one region B in the grains of said emulsion contains at least 10 mol-% AgBr, but less than 50 mol-% AgBr.

8. A process for the production of photographic recordings by developing an imagewise exposed recording material in the presence of a phenylene diamine, wherein a recording material according to claim 7 is used.

* * * * *